United States Patent [19]

Goldney et al.

[11] Patent Number: 4,619,403

[45] Date of Patent: Oct. 28, 1986

[54] SPRAY GUNS FOR SPRAYING LIQUIDS

[75] Inventors: Dennis G. Goldney; Bryn Evans, both of Aylesbury, England

[73] Assignee: Hozelock-ASL Limited, Aylesbury, England

[21] Appl. No.: 685,161

[22] Filed: Dec. 21, 1984

[30] Foreign Application Priority Data

Feb. 8, 1984 [GB] United Kingdom ..... 8403275

[51] Int. Cl.[4] ..... B05B 1/12

[52] U.S. Cl. ..... 239/456; 239/526; 251/230

[58] Field of Search ..... 239/451, 456, 525, 526; 251/102, 103, 230

[56] References Cited

U.S. PATENT DOCUMENTS

| | | | |
|---|---|---|---|
| 1,206,320 | 11/1916 | Gitler | 251/103 |
| 2,657,098 | 10/1953 | Strahman | 239/526 X |
| 3,006,560 | 10/1961 | Rosenkranz | 239/526 X |
| 3,888,421 | 6/1975 | Chow | 239/526 X |

FOREIGN PATENT DOCUMENTS

| | | | |
|---|---|---|---|
| 456335 | 4/1950 | Italy | 251/102 |

*Primary Examiner*—Andres Kashnikow

*Attorney, Agent, or Firm*—Lee, Smith & Zickert

[57] ABSTRACT

A pistol grip spray gun for the incremental control of sprayed liquids. The gun has a handle, an actuating member movable with respect to the handle in the manner of a trigger, and a barrel with an outlet for delivering a spray of the liquid. The actuating member is movable from a closed position thereof, corresponding to a closed condition of the nozzle, through a range of open positions with differing spray characteristics. A retention system is provided for retaining the actuating member in a selected position in the range of open positions. A release button is employed for releasing the retention system to permit the actuating member to return to or toward its closed position. In this manner, the spray characteristics of the gun can be varied, and retained in any chosen characteristic, by control of the trigger without the necessity of a separate adjustment of the nozzle.

9 Claims, 3 Drawing Figures

SPRAY GUNS FOR SPRAYING LIQUIDS

FIELD OF THE INVENTION

This invention relates to spray guns for spraying liquids, for example spray guns for attachment to water hoses for spraying water for watering plants or washing purposes.

BACKGROUND TO THE INVENTION

A known form of spray gun has a spray nozzle openable by movement of a trigger. The spray characteristics, i.e. the fineness of the spray and its range, are controlled by rotation of a collar on the spray nozzle. An object of the present invention is to provide a spray gun in which the spray characteristics can be varied, and retained in any chosen characteristic, by control of the trigger without the necessity of a separate adjustment at the nozzle.

SUMMARY OF THE INVENTION

According to the invention a pistol grip spray gun has a handle, an actuating member movable with respect to the handle in the manner of a trigger, a barrel with an outlet for delivering a spray of the liquid, the actuating member being movable from a closed position thereof, corresponding to a closed condition of the nozzle, through a range of open positions with differing spray characteristics, retaining means for retaining the actuating member in a selected position in the range of open positions, and release means for releasing the retaining means to allow the actuating member to return to or towards its closed position.

The retaining means conveniently comprise ratchet means. Such rachet means preferably comprise a ratchet wheel and an arm which is urged into engagement with the wheel, the ratchet wheel being caused to rotate when the actuating member is moved relative to the handle, the teeth of the ratchet wheel sliding over the ratchet arm when the actuating member is moved away from its closed position, but the ratchet arm engaging the ratchet wheel to prevent return movement of the actuating member towards the closed position thereof.

The actuating member is preferably pivotally mounted with respect to the handle, and the ratchet wheel and arm may be mounted in the handle.

The release means conveniently include a manually operable member which is capable of moving the ratchet arm out of engagement with the ratchet wheel, to free the latter. The manually operable member may be a release button on the trigger.

In the preferred embodiment to be described, the ratchet wheel is caused to rotate with movement of the actuating member by virtue of the ratchet wheel being mounted on a common spindle with a pinion wheel which meshes with a toothed formation, such as a rack, carried by the handle. To spread the force of the ratchet means, the ratchet wheel is one of two such laterally spaced wheels mounted on the common spindle, the ratchet arm engaging both wheels. The pinion wheel is mounted between the ratchet wheels and engages the rack on a central plane of the handle and actuating member.

Return means are preferably provided to bias the nozzle to the closed condition. In one preferred arrangement, a return spring is arranged to bias the actuating member towards the closed position thereof.

The spray gun may include a liquid inlet, and in one preferred embodiment an adaptor for connection to a hosepipe is secured to the handle, the handle comprising a tube in fluid communication with the barrel.

A preferred embodiment pistol grip spray gun according to the invention will now be described, by way of example, with reference to the accompanying drawings in which.

DETAILED DESCRIPTION OF THE DRAWINGS

Figure 1:
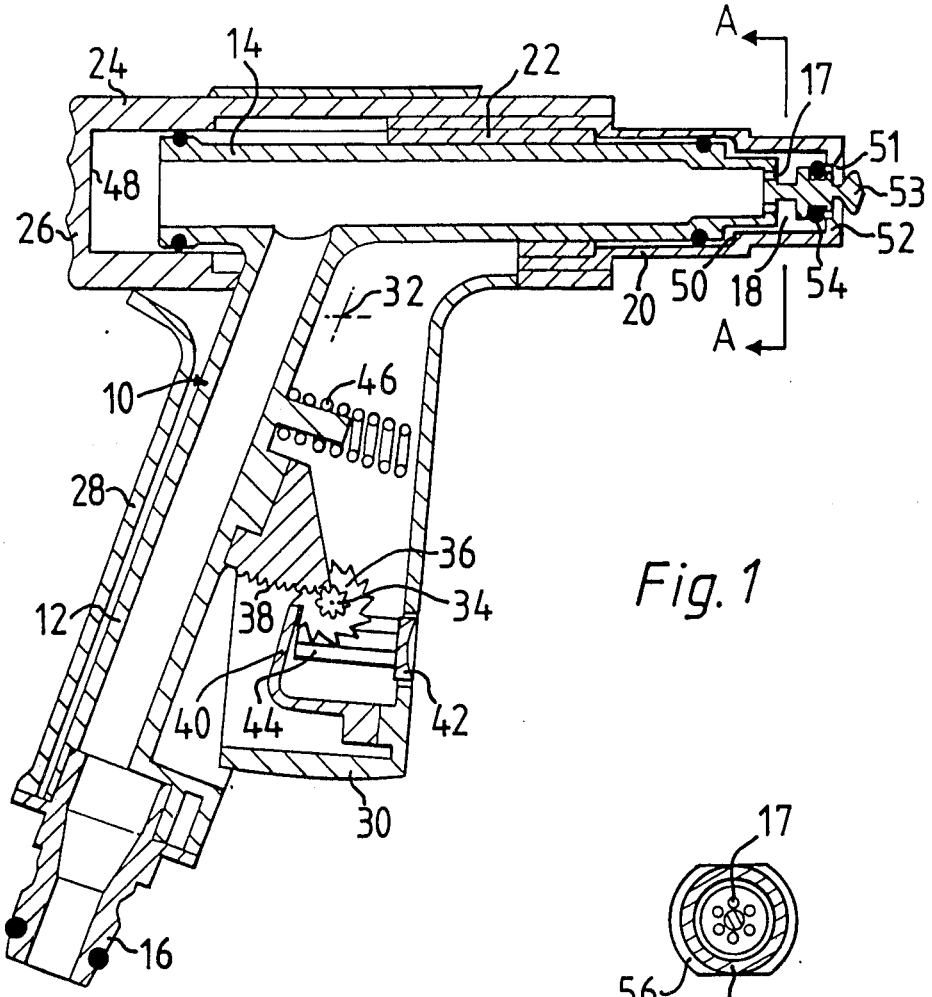
FIG. 1 is a sectional view through the central plane of symmetry of the spray gun.
Figure 2:
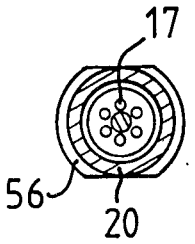
FIG. 2 is a sectional view along line A—A of FIG. 1.

Referring to the drawings, the illustrated spray gun has a hollow main body 10 having a handle part 12 and a barrel part 14. At its lower end, the handle part 12 is connected to an adaptor 16 for connection of a hose pipe (not shown). At its forward end, the barrel part 14 has a series of 6 symmetrically arranged orifices 17 passing through the barrel end wall, leading to chamber 18. Around the barrel the body is surrounded by a slidable assembly of three interconnected sleeves, namely a front sleeve 20, an intermediate sleeve 22 and a rear sleeve 24 which has an end wall 26 closing off the rear of the barrel.

An adjustable spray nozzle 51 is formed at the front end of the barrel where barrel end 53 passes through a circular orifice defined by annular nozzle lip 52. In the closed condition (as shown) O-ring seal 54 carried towards the front end of the barrel engages the nozzle lip 52.

Around the handle, the main body is shrouded by a handle casing 28 which is U-shaped in cross-section. The two spaced limbs of the U-shape of the casing 28 provide a pivot bearing for an actuating member in the form of a trigger 30 which is therefore pivotally movable with respect to the handle about the transverse axis indicated at 32 in FIG. 1.

The trigger 30 is also U-shaped in cross-section, and within the channel of this U-shape, the trigger has a transverse spindle on which are mounted a pinion wheel 34 and two spaced ratchet wheels 36, only one of which is visible in FIG. 1. The pinion wheel 34 meshes with an arcuate toothed rack 38 carried by and projecting from the handle part 12. The two ratchet wheels 36, which are spaced on respective sides of the pinion wheel 34, are engaged by a ratchet spring arm 40. A release button 42 on the front face of the trigger 30 has a rearwardly extending stem 44 which, on depression of the button 42, pushes the ratchet arm 40 out of engagement with the ratchet wheels 36 to release the trigger 30 for return movement.

A return spring 46 is provided to bias the trigger 30 to its normal, closed position shown in the drawing. When in use, water pressure provides sufficient bias (by virtue of the area 48 being greater than the annular area 50) to urge the sleeves 20, 22 and 24 towards the left as viewed in the drawing, but the spring 46 enables the gun to be tried or demonstrated without being connected to a supply of water under pressure.

Figure 3:
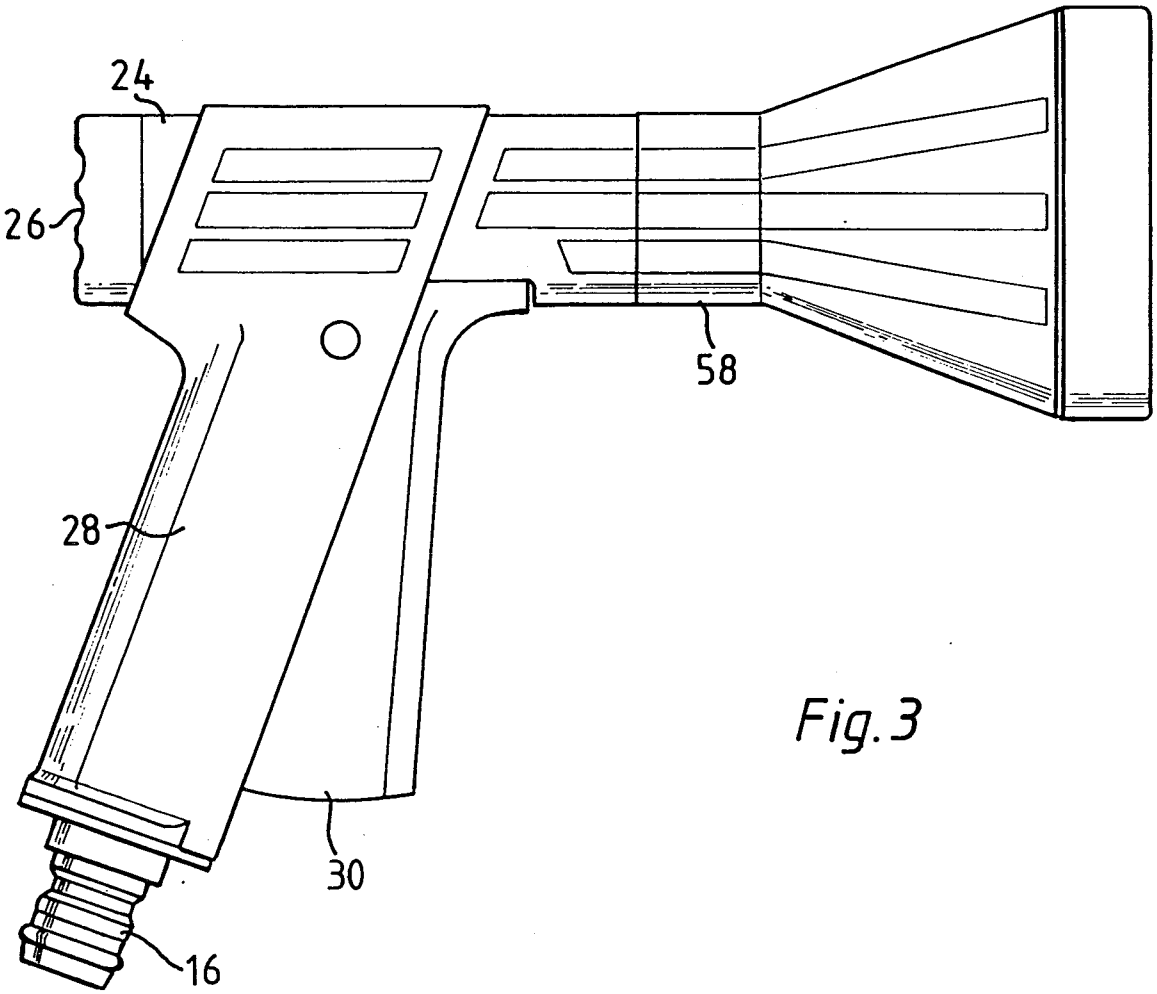
FIG. 3 is a side view of the spray gun of FIGS. 1 and 2, with a spray rose attachment.

The sleeve 20 includes a threaded portion 56 to enable interchangeable attachment of fittings, such as spray rose attachment 58 shown in FIG. 3.

The main body 10, adaptor 16 and handle casing 28 are moulded from ABS plastics material. The trigger 30, the three sleeves 20, 22 and 24 and the ratchet wheels and ratchet arm are moulded in acetal.

When the spray gun is connected to a supply of water, the water fills the hollow main body 10 and biases the three interconnected sleeves 20, 22 and 24 towards the closed position in which the outlet nozzle 51 is closed (as illustrated). When the trigger 30 is pulled towards the handle part 12 against the bias of the spring 46 and the water pressure, the trigger urges the sleeves 20, 22 and 24 towards the right, thereby moving the end nozzle lip 52 away from the O-ring seal 54 to open the nozzle 51. Further movement of the trigger 30 causes progressive opening of the nozzle with attendant variation in spray characteristics. The trigger 30 may be released and will be retained at any intermediate position through its range of open positions, by virtue of the ratchet mechanism provided by the ratchet arm 40 and ratchet wheels 36. Depression of the button 42 releases the ratchet mechanism and the trigger returns under the action of water pressure and spring 46 to its normal position corresponding to a closed condition of the nozzle.

We claim:

1. A pistol grip spray gun comprising:

(a) a handle, (b) a barrel with an outlet nozzle for delivering a spray of liquid, (c) an actuating member movable with respect to the handle in the manner of a trigger, the actuating member being movable from a closed position thereof, corresponding to a closed condition of the nozzle, along a path through a range of open positions with differing spray characteristics of the nozzle, (d) retaining means for retaining the actuating member in a selected position in the range of open positions, the retaining means comprising a ratchet wheel and an arm which is normally urged into engagement with the wheel, the ratchet wheel being caused to rotate when the actuating member is moved relative to the handle, with the teeth of the ratchet wheel sliding over the ratchet arm when the actuating member is moved away from its closed position, and with the ratchet arm normally engaging the ratchet wheel to prevent return movement of the actuating member towards the closed position thereof, and (e) release means comprising a manually operable release button on the actuating member normally out of operative engagement with the ratchet arm, movement of the release button in the direction of said path and relative to the actuating member causing movement of the ratchet arm out of engagement with the ratchet wheel, to free the latter, thus allowing the actuating member to return to or towards its closed position.

2. A spray gun according to claim 1, in which the ratchet wheel and arm are mounted in the handle.

3. A spray gun according to claim 1, in which the ratchet wheel is caused to rotate with movement of the actuating member by virtue of the ratchet wheel being mounted on a common spindle with a pinion wheel which meshes with a toothed formation carried by the handle.

4. A spray gun according to claimm 3, in which the toothed formation comprises a rack.

5. A spray gun according to claim 3, in which the ratchet wheel is one of two such laterally spaced wheels mounted on the common spindle, the ratchet arm engaging both wheels, and the pinion wheel is mounted between the ratchet wheels and engages the toothed formation on a central plane of the handle and actuating member.

6. A spray gun according to claim 1, in which the actuating member is pivotally mounted with respect to the handle.

7. A spray gun according to claim 1, in which return means are provided to bias the nozzle to the closed condition.

8. A spray gun according to claim 7, in which a return spring is arranged to bias the actuating member towards the closed position thereof.

9. A spray gun according to claim 1, in which an adaptor for connection to a hosepipe is secured to the handle, the handle comprising a tube in fluid communication with the barrel.

* * * * *